US006519512B1

(12) United States Patent
Haas et al.

(10) Patent No.: US 6,519,512 B1
(45) Date of Patent: Feb. 11, 2003

(54) METHOD AND APPARATUS FOR PROVIDING ENHANCED VEHICLE DETECTION

(75) Inventors: Kevin L. Haas, Bartlett, IL (US); Frank D. Panzica, Chicago, IL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/996,548

(22) Filed: Nov. 28, 2001

(51) Int. Cl.[7] ..... G06F 7/00

(52) U.S. Cl. ..... 701/19; 340/425.5; 340/438; 340/439

(58) Field of Search ..... 701/19; 340/425.5, 340/438, 439, 907; 246/292, 296

(56) References Cited

U.S. PATENT DOCUMENTS 4,942,395 A * 7/1990 Ferrari et al. ..... 340/907

* cited by examiner

*Primary Examiner*—Gertrude Arthur

(74) *Attorney, Agent, or Firm*—Steven R. Santema; Valerie M. Davis

(57) ABSTRACT

Detection of a locomotive or other vehicle is enhanced by transmitting an RF alert signal from the vehicle when the vehicle approaches a heightened alert area such as a railroad crossing. The RF alert signal is received by communication unit(s) carried by pedestrian(s) or residing in vehicle(s) approaching the heightened alert area, thereby providing an alert that supplements train whistles, gates, horns or other warning mechanisms known in the art. The RF alert signal may also be transmitted to infrastructure devices such as logging devices. In one embodiment, the RF alert signal is transmitted from a locomotive upon detecting operation of a train whistle associated with the locomotive and/or coincident to receiving an external alert signal or automatic vehicle location (AVL) information indicating that the locomotive is near a heightened alert area.

21 Claims, 3 Drawing Sheets

METHOD AND APPARATUS FOR PROVIDING ENHANCED VEHICLE DETECTION

FIELD OF THE INVENTION

This invention relates generally to communication systems and, more particularly, to a public safety communication system that enhances the detection of vehicles, including but not limited to locomotives.

BACKGROUND OF THE INVENTION

Many persons, including pedestrians, drivers and occupants of vehicles, are killed or injured each year as a result of collisions with moving vehicles including, but not limited to trains or locomotives. Oftentimes, the collisions may be attributed to the persons being unaware of their proximity to the other vehicle (and hence being unaware of the danger of being struck by the vehicle) until it is too late to avoid the collision. Although the other vehicle may be equipped with warning mechanism(s) such as, for example, horns, whistles, lights, etc., such warning(s) may not be issued by the operator of the vehicle quickly enough, if at all, for the prospective injured persons to avoid the collision. Moreover, even if the warnings are otherwise issued in time, they may go unnoticed by the persons in danger of a potential collision due to poor lighting or weather conditions or poor audio conditions, perhaps resulting from the persons listening to the radio, personal stereo or the like, or being distracted by a conversation.

In the case of train collisions, most, if not all locomotives are equipped with a train whistle that is sounded upon the train approaching a heightened alert area, such as a railroad crossing. Typically, this is accomplished by an engineer operating the train whistle when the train approaches a landmark known as a whistle post, about ¼ mile from the railroad crossing. Hence, the train whistle is designed to alert pedestrians or vehicles at a railroad crossing (or other heightened alert area) that a train is approaching. Oftentimes, the railroad crossing will also include gates or warning lights to alert persons of the approaching train. However, even if the railroad crossing is equipped with gates and/or warning lights, persons will often bypass the gates if they do not see the train or hear the train whistle. As has been noted generally above, there is a risk that the persons will not hear the train whistle if they are distracted, listening to the radio, etc. and, consequently, they may cross the tracks at their peril.

Accordingly, there is a need for a method and apparatus that enhances the ability of persons to detect approaching vehicles, thereby accelerating their awareness and reaction to potential collision situations. Advantageously, the method and apparatus may be used for train or locomotive detection in a manner that is supplementary to existing train whistles, gates, lights, etc. The present invention is directed to satisfying these needs.

BRIEF DESCRIPTION OF THE DRAWINGS

The foregoing and other advantages of the invention will become apparent upon reading the following detailed description and upon reference to the drawings in which.

DESCRIPTION OF PREFERRED EMBODIMENTS

Figure 1:
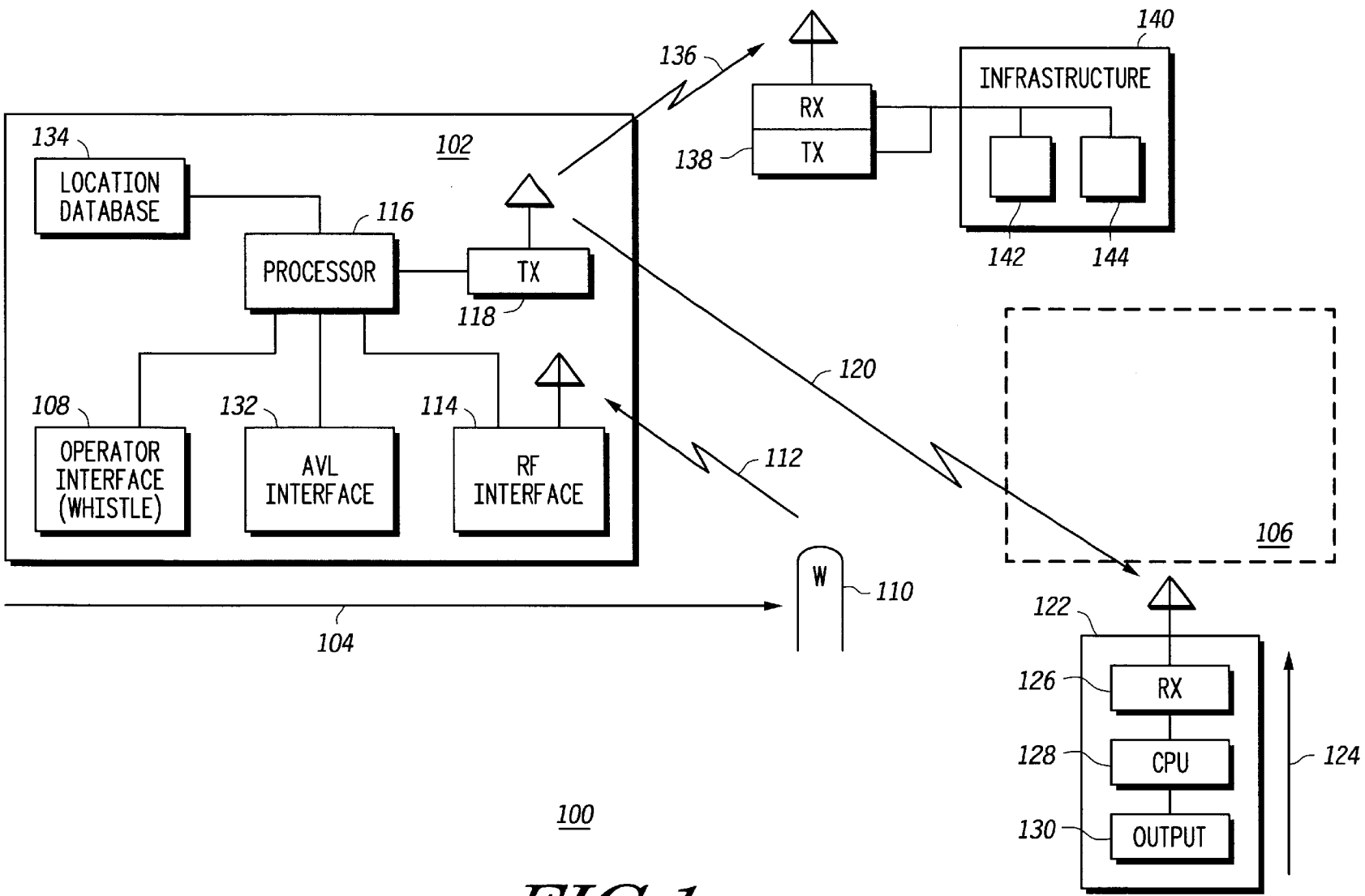
FIG. 1 is a block diagram of a communication system including a locomotive implementing a method of enhanced vehicle detection according to one embodiment of the invention.

Turning now to the drawings and referring initially to FIG. 1, there is shown a communication system 100 that includes a locomotive 102 implementing a method of enhanced vehicle detection according to the invention. As defined herein, the term "locomotive" refers to a group of one or more interconnected train cars traveling by a commercial, industrial or commuter railway system, subway or elevated transit system. The locomotive 102 is adapted for movement throughout the railway system (direction of travel indicated by arrow 104) such that it periodically encounters a heightened alert area 106. The heightened alert area 106 may comprise, for example, a railroad crossing or generally any geographic location or area where heightened alert and/or awareness of approaching locomotives by vehicle or pedestrian traffic is needed or desired.

The locomotive 102 includes an operator interface 108 for activating a train whistle (not shown) upon the train approaching the heightened alert area 106. The operator interface 108 may comprise a switch, keypad, pull mechanism or generally any user-machine interface presently known or devised in the future. Typically, in the case where the heightened alert area is a railroad crossing, an engineer is instructed to operate the train whistle when the locomotive 102 passes a whistle post 110 or other suitable landmark that is situated a predetermined distance (e.g., ¼ mile) from the railroad crossing. As will be appreciated, the engineer might also exercise his or her judgment at times to activate the train whistle independent from train passing the whistle post or fixed landmark.

Nevertheless, in the case where the train whistle is to be sounded upon passing a whistle post 110, the present invention contemplates that radio frequency (RF) "alert" signals 112 be emitted at or near the whistle post 110 such that the signals 112 may be received by an RF interface 114 and communicated to a processor 116 of the locomotive 102. The processor 116 may comprise any specialized or general purpose computing device (e.g., a microprocessor, microcontroller, digital signal processor or combination of such devices) that is adapted to execute programming instructions stored in memory (not shown). As will be appreciated, the RF alert signals 112 may be transmitted continuously or intermittently and may be physically realized by virtually any known RF resource such as, for example, narrow band frequency modulated channels, time division modulated slots, carrier frequencies, frequency pairs, etc. The structure and content of the RF alert signal(s) 112 may be implemented in virtually any manner.

Generally, the RF alert signal(s) 112 either encode information ("messages") associated with the alert or are recognizable as alert signals independent of their message content. Upon receiving the alert signals 112, the processor 116 operates according to suitable programming instructions to cause the train whistle to be activated either automatically (i.e., without operator intervention) or indirectly (i.e., by signaling the engineer to activate the train whistle). In such manner, the train whistle will be sounded even if, for whatever reason, the engineer did not otherwise see or react to the train passing the whistle post.

According to one embodiment of the present invention, the processor 116 is adapted to monitor operation of the train whistle 108 and, upon detecting operation of the train whistle, causes a supplemental warning signal 120 (i.e., supplemental to the train whistle) to be transmitted via transmitter 118 to one or more receiving devices. In one embodiment, activation of the train whistle causes an electrical signal to be communicated from the operator interface 108 to the processor and, hence detection of the train whistle is accomplished upon the processor 116 receiving the electrical signal. As will be appreciated, however, detecting operation of the train whistle may be accomplished in generally any manner, including acoustic or electromechanical sensors, and the like. In any case, the processor may detect operation of the train whistle coincident to the whistle being activated by an operator or coincident to the whistle being activated automatically (i.e., responsive to the RF alert signal 112).

The transmitter 118 communicates the supplemental warning signal 120 via RF resources to a radio communication unit 122 associated with a person or vehicle that is approaching (or is about to approach) the heightened alert area 106. In FIG. 1, the direction of travel of the communication unit 122 toward the heightened alert area is indicated by arrow 104. The RF resources may comprise, for example, narrow band frequency modulated channels, time division modulated slots, carrier frequencies, frequency pairs, etc. The radio communication unit may comprise a mobile or portable radio unit, cellular telephony device or generally any wireless communication device that is eligible to be carried by a person or vehicle proximate to the heightened alert area 106. The radio communication unit 122 includes an RF receiver 126 and processor 128 for receiving and processing, respectively, the supplemental warning signal 120; and an output device 130 (e.g., display, speaker(s), etc.) for communicating the supplemental warning signal to the operator of the communication unit 122.

As shown, the transmitter 118 also communicates location alert information via RF resource 136 to an RF base site transceiver ("base station") 138. The RF resource 136 may comprise, for example, narrow band frequency modulated channels, time division modulated slots, carrier frequencies, frequency pairs, etc. The base station 138 is connected to a railway system infrastructure 140 including various communications infrastructure devices 142, 144. The infrastructure devices 142, 144 may comprise, for example, logging devices, dispatch consoles or other equipment that enables the railway system infrastructure to record and/or track the location alert information and other mobility information associated with the locomotive 102.

In one embodiment, the locomotive 102 further includes an automated vehicle location (AVL) interface 132 for receiving location information. The AVL interface 132 may comprise, for example, a Global Positioning System (GPS) receiver connected to a GPS antenna, for receiving GPS-assisted location information associated with the locomotive. The processor 118 is operable upon receiving the location information, to compare the information to stored map data (in location database 134) to determine the proximity of the locomotive to the heightened alert area. If the proximity is within a predetermined distance threshold (e.g., ¼ mile) from the heightened alert area, the processor causes the train whistle 108 to be activated, either automatically (i.e., without operator intervention) or indirectly (i.e., by signaling the operator to activate the train whistle). Then, upon detecting the train whistle, the processor causes a supplemental warning signal to be communicated via RF resource(s) 120 or 136 to the communication unit 122 approaching the heightened alert area 106 or to the railway system infrastructure 140, substantially as heretofore described. Alternatively, the processor may cause location alert information to be communicated to the communication unit 122 or to the railway system infrastructure 140 independent from the train whistle. That is, in such case, the train whistle need not be operated for the locomotive to send out location alert information to the communication unit 122 or infrastructure 140.

Figure 2:
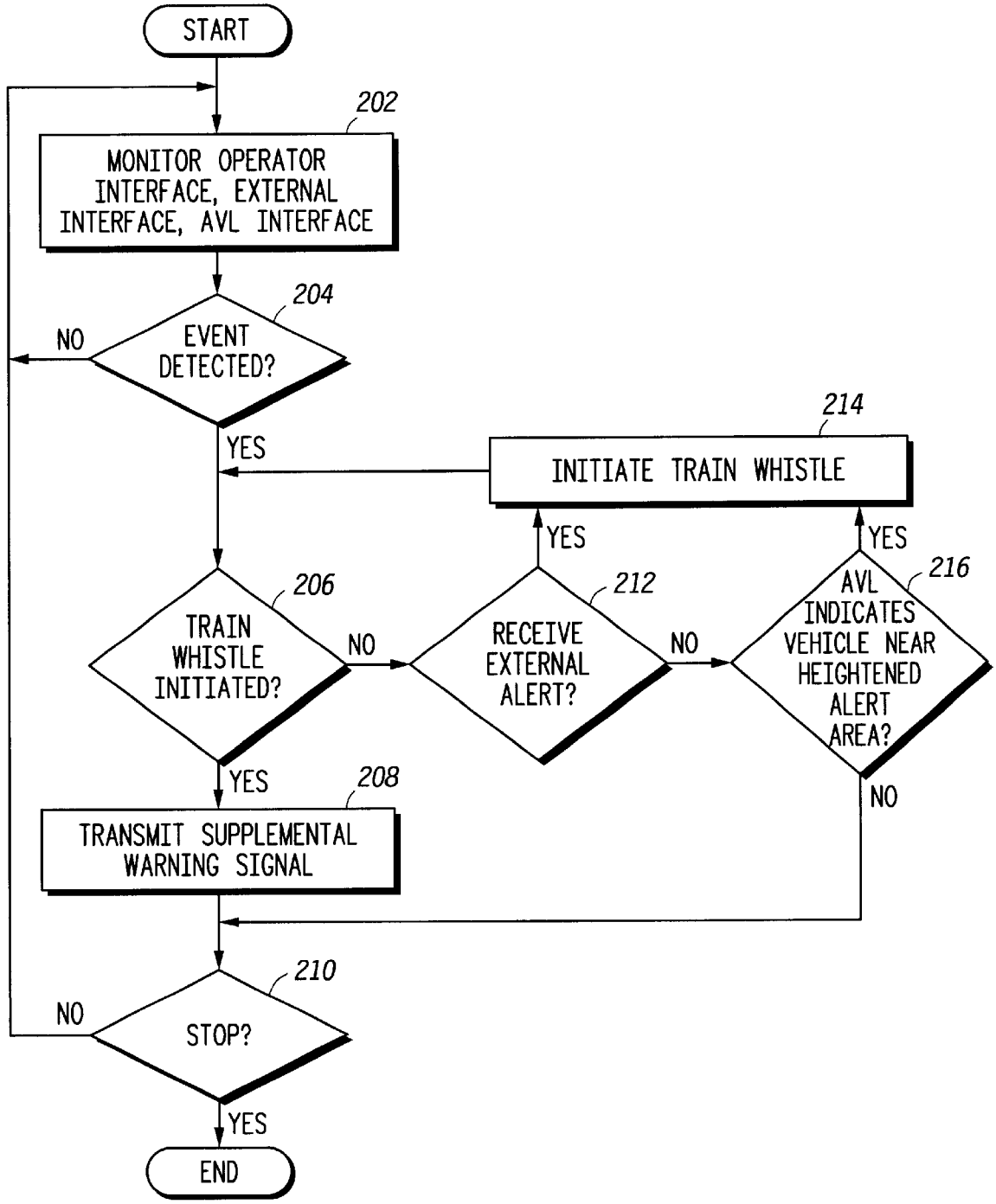
FIG. 2 is a flowchart showing a method of enhanced vehicle detection implemented by a locomotive according to one embodiment of the invention.

FIG. 2 is a flowchart illustrating steps performed by the processor 116 to enhance detection of the locomotive 102 by persons or vehicles. At step 202, the processor monitors the operator interface, external interface and AVL interface until such time as an event is detected at step 204 for which heightened alert by pedestrians or vehicles is desired. The event may comprise an incident where the train whistle is initiated, for example, by an operator coincident to the train approaching a heightened alert area such as a railroad crossing; an incident where an external alert signal (e.g., RF alert signal 112) is received indicating proximity to the heightened alert area; or coincident to the AVL system indicating a proximity of the train to the heightened alert area. All of these instances indicate an event for which heightened alert by pedestrians or vehicles is desired.

The processor determines at step 206 whether the train whistle has initiated. In the instance where the train whistle has been initiated, the processor transmits a supplemental warning signal at step 208. In one embodiment, as has been described in relation to FIG. 1, the supplemental warning signal 120 comprises an RF signal that may be received by a suitably equipped radio communication unit 122 carried by a pedestrian or vehicle approaching the heightened alert area 106. In such manner, the pedestrian or occupants in the vehicle will become alerted to the approaching train even though they may not have heard the train whistle. The supplemental warning signal may be discontinued after a predetermined time period has elapsed or alternatively, may continue until such time as it is turned off by an operator, via the operator interface 108. The process returns to step 202 to monitor additional events until such time as the process is stopped at step 210. The process may stopped, for example, when the train is stopped or generally whenever the supplemental warning signal is no longer needed or desired.

If the train whistle has not been initiated, the processor determines at step 212 whether an external alert signal has been received. For example, the processor may receive an RF alert signal, via the RF interface 114, transmitted at or near a whistle post 110 about ¼ mile from a railroad crossing. In such case, the processor initiates activation of the train whistle at step 214, either automatically (i.e., without operator intervention) or indirectly (i.e., by signaling the operator to activate the train whistle). The processor, in either case, will detect operation of the train whistle at step 206 and will transmit a supplemental warning signal at step 208.

If neither the train whistle is initiated nor an external signal is received that triggers initiation of the train whistle, the process proceeds to step 216 where it is determined whether the AVL system indicates the train is near the heightened alert area. That is, whether the train is near enough to the heightened alert area to trigger an alert. In one embodiment, this determination is made by comparing a location of the train to a location of the heightened alert area and making a positive determination if the two locations are within a predetermined distance threshold (e.g., ¼ mile). In such case, the processor initiates activation of the train whistle at step 214, either automatically (i.e., without operator intervention) or indirectly (i.e., by signaling the operator to activate the train whistle). The processor, in either case, will detect operation of the train whistle at step 206 and will transmit a supplemental warning signal at step 208.

Figure 3:
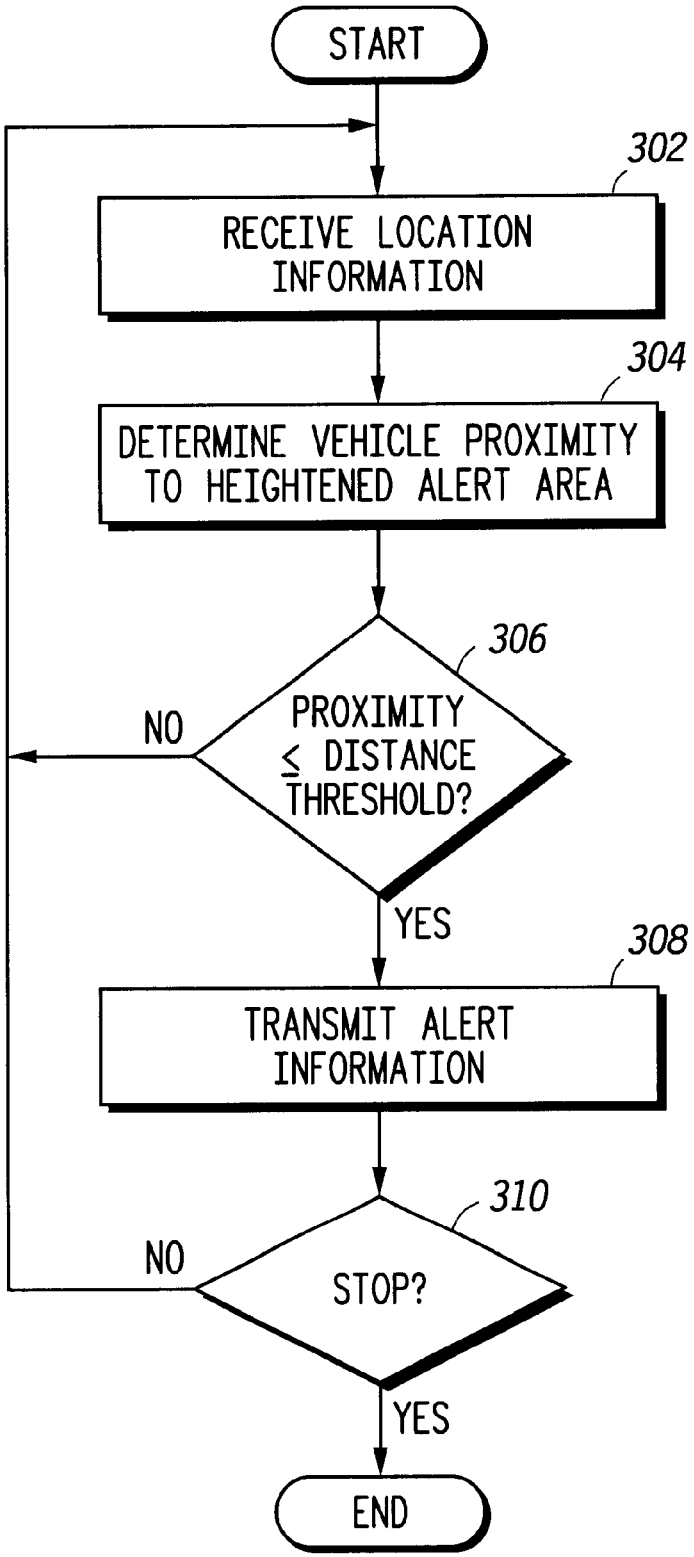
FIG. 3 is a flowchart showing an alternative method of enhanced vehicle detection according to one embodiment of the invention.

Now turning to FIG. 3, there is shown another method of enhancing detection of a vehicle. The vehicle may comprise a locomotive 102, such as shown in FIG. 1, or generally may comprise any vehicle equipped with a processor, AVL interface and RF transmitter. The steps of FIG. 3 are is implemented by the processor of the vehicle. At step 302, the processor receives automatic vehicle location (AVL) information or other location information indicating the vehicle's position. Based on the location information, the processor determines at step 304 the vehicle's proximity to a heightened alert area. For instance, in the example of FIG. 1, the processor 116 determines the proximity of the locomotive 102 to the heightened alert area 106. At step 306, the processor determines whether the proximity of the vehicle to the heightened alert area is within a predetermined distance threshold (e.g., ¼ mile).

If the proximity of the vehicle relative to the heightened alert area falls within the predetermined threshold, the processor causes alert information to be transmitted automatically from the vehicle at step 308 (e.g., via the RF transmitter 118). In such manner, alert information may be received by a suitably equipped radio communication unit 122 carried by a pedestrian or vehicle approaching the heightened alert area 106. Thus, the method of FIG. 3 provides for automatically transmitting alert information to a vehicle or pedestrian independent of any other alert mechanism (e.g., train whistle or the like) and independent from the vehicle receiving any RF alert signal.

The present disclosure therefore has identified methods and devices for enhancing the ability of persons to detect approaching vehicles, thereby accelerating their awareness and reaction to potential collision situations. The methods may be implemented to enhance the detection of locomotives in a manner that is supplementary to existing train whistles, gates, lights, etc.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. In a locomotive having a train whistle adapted for sounding a warning signal on occasion of the locomotive approaching a heightened alert area, a method comprising:

monitoring operation of the train whistle;

automatically, upon detecting operation of the train whistle, transmitting a supplemental warning signal to one or more prospective receiving devices.

2. The method of claim 1, wherein the step of transmitting a supplemental warning signal comprises transmitting a radio frequency (RF) alert signal to one or more vehicles proximate to the heightened alert area.

3. The method of claim 2, wherein the RF alert signal includes location information associated with the locomotive.

4. The method of claim 1, wherein the step of transmitting a supplemental warning signal comprises transmitting location information associated with the locomotive to one or more railroad communications infrastructure devices.

5. The method of claim 4, wherein the railroad communications infrastructure devices include a logging device.

6. The method of claim 1, wherein the step of monitoring operation of the train whistle comprises detecting operator initiation of the train whistle.

7. The method of claim 6, wherein the heightened alert area comprises a railroad crossing, the operator initiation of the train whistle being accomplished coincident to the locomotive approaching the railroad crossing.

8. The method of claim 1, wherein the step of monitoring operation of the train whistle comprises detecting operation of the train whistle coincident to receiving an external alert signal.

9. The method of claim 8, wherein the heightened alert area comprises a railroad crossing, the external alert signal comprising a radio frequency (RF) signal transmitted from a landmark near the railroad crossing.

10. The method of claim 1, wherein the step of monitoring operation of the train whistle comprises detecting operation of the train whistle coincident to receiving an automatic vehicle location (AVL) signal indicating a proximity of the locomotive to the heightened alert area.

11. The method of claim 10, wherein the heightened alert area comprises a railroad crossing, the AVL signal indicating a geographic position of the locomotive near the railroad crossing.

12. A method comprising:

receiving automatic vehicle location (AVL) information indicating a position of a vehicle;

automatically, responsive to receiving the AVL information, determining a proximity of the vehicle position relative to a heightened alert area and, if the proximity is within a predetermined distance threshold, transmitting alert information from the vehicle.

13. The method of claim 12, wherein the vehicle comprises a locomotive having a train whistle, the step of transmitting alert information comprises initiating the train whistle from the locomotive proximate to the heightened alert area.

14. The method of claim 12, wherein the step of receiving AVL information comprises receiving global positioning system (GPS) information.

15. The method of claim 12, wherein the step of transmitting alert information comprises transmitting a radio frequency (RF) alert signal from the vehicle proximate to the heightened alert area.

16. The method of claim 12, wherein the step of transmitting alert information comprises transmitting a location alert signal from the vehicle to one or more communications infrastructure devices.

17. In a locomotive adapted for movement relative to a railroad crossing area, an apparatus comprising:

interface means for generating a first alert signal upon the locomotive approaching the railroad crossing area;

a processor being operable to detect the first alert signal and, automatically, responsive to detecting the first alert signal, to generate a second alert signal; and a radio frequency (RF) transmitter for transmitting the second alert signal to one or more prospective receiving devices.

18. The apparatus of claim 17, wherein the interface means comprises an operator interface.

19. The apparatus of claim 18, wherein the first alert signal comprises a train whistle initiated by an operator coincident to the locomotive approaching the railroad crossing area.

20. The apparatus of claim 17, wherein the interface means comprises an external radio frequency (RF) interface adapted to receive an RF warning signal coincident to the locomotive approaching the railroad crossing area.

21. The apparatus of claim 17 wherein the interface means comprises an automatic vehicle location (AVL) interface adapted to receive an AVL signal indicating a proximity of the locomotive to the railroad crossing area.

* * * * *